US009909587B2

(12) United States Patent
Yang et al.

(10) Patent No.: US 9,909,587 B2
(45) Date of Patent: Mar. 6, 2018

(54) REFRIGERANT FILLING ROTARY COMPRESSOR

(71) Applicant: GUANGDONG MEIZHI COMPRESSOR CO., LTD., Foshan (CN)

(72) Inventors: Guoyong Yang, Foshan (CN); Weimin Xiang, Foshan (CN); Jijiang Yu, Foshan (CN); Hong Guo, Foshan (CN); Jingtao Yang, Foshan (CN); Cheng Zhang, Foshan (CN)

(73) Assignee: Guangdong Meizhi Compressor Co., Ltd., Foshan (CN)

( * ) Notice: Subject to any disclaimer, the term of this patent is extended or adjusted under 35 U.S.C. 154(b) by 0 days.

(21) Appl. No.: 14/394,324

(22) PCT Filed: Sep. 30, 2013

(86) PCT No.: PCT/CN2013/084704
§ 371 (c)(1),
(2) Date: Oct. 14, 2014

(87) PCT Pub. No.: WO2015/042947
PCT Pub. Date: Apr. 2, 2015

(65) Prior Publication Data

US 2016/0201677 A1 Jul. 14, 2016

(51) Int. Cl.
*F04C 29/12* (2006.01)
*F04C 18/356* (2006.01)
*F04C 23/00* (2006.01)

(52) U.S. Cl.
CPC ..... *F04C 29/124* (2013.01); *F04C 18/3564* (2013.01); *F04C 18/3568* (2013.01); (Continued)

(58) Field of Classification Search
CPC ..... F04C 29/124; F04C 18/3564; F04C 18/3568; F04C 2250/101; F04C 23/001; F04C 23/008; F04C 29/128
See application file for complete search history.

(56) References Cited

U.S. PATENT DOCUMENTS 8,985,984 B2 * 3/2015 Ogata ..... F04C 18/3564 418/209

FOREIGN PATENT DOCUMENTS

CN 101624985 A 1/2010
CN 202132235 U 2/2012
(Continued)

OTHER PUBLICATIONS

PCT/CN2013/084704 English Translation of the International Search Report and Written Opinion mailed Jul. 8, 2014, 7 pages.
(Continued)

*Primary Examiner* — Mary A Davis
(74) *Attorney, Agent, or Firm* — Lathrop Gage LLP

(57) ABSTRACT

A refrigerant filling rotary compressor includes a shell, a compressing mechanism, an injection tube and an injection valve assembly. The compressing mechanism includes a cylinder, a main bearing, an auxiliary bearing, a crank shaft, a piston and a sliding vane. An inner wall of the cylinder chamber of the cylinder is formed with a filling mouth, and the cylinder is provided with a filling channel with a filling hole. The injection valve assembly is in a closed state when a pressure inside the cylinder chamber is higher than that in the filling hole so as to separate the filling hole from the filling mouth, and the injection valve assembly is in an open state when the pressure inside the cylinder chamber is lower than that in the filling hole so as to communicate the filling hole with the filling mouth, in which when the injection valve assembly is in the closed state, a space between the injection valve assembly and the filling mouth where a compressed gas exists is termed a clearance volume formed by the injection valve assembly, and a ratio between the clearance volume formed by the injection valve assembly and a reserve volume of the cylinder ranges from 0.3% to 1.5%.

20 Claims, 4 Drawing Sheets

(52) U.S. Cl.
CPC ..... *F04C 23/001* (2013.01); *F04C 23/008* (2013.01); *F04C 29/128* (2013.01); *F04C 2250/101* (2013.01)

(56) References Cited

FOREIGN PATENT DOCUMENTS

| | | | |
|---|---|---|---|
| CN | 202301033 | U | 7/2012 |
| JP | H0337391 | A | 2/1991 |
| JP | 2004324652 | A | 11/2004 |
| JP | 2013036442 | A | 2/2013 |
| WO | 2012004993 | A1 | 1/2012 |

OTHER PUBLICATIONS

Yang, Renping, Increasing compressor COP value by reducing clearance volume, Appliance Technology, No. 12, 2011, p. 1, Dec. 31, 2011, Abstract.
CN 201310461632.3 Brief Summary of Examination History, and English translation First Notification of Office Action dated Jun. 3, 2015 and Second Office Action dated Nov. 2, 2015; 12 pages.
Japanese application No. 2015-538266, First Notification of Office Action, Nov. 9, 2015 with brief translation, 8 pages.
Japanese application No. 2015-538266, Second Notification of Office Action, Jul. 14, 2016 with brief translation, 5 pages.
Korean Patent Application: 9-5-2016-034404907, First Notification of Office Action, May 12, 2016 with brief translation, 12 pages.

* cited by examiner

REFRIGERANT FILLING ROTARY COMPRESSOR

CROSS-REFERENCE TO RELATED APPLICATION

This U.S. application claims priority under 35 U.S.C 371 to, and is a U.S. National Phase application of, the International Patent Application No. PCT/CN2013/084704, filed Sep. 30, 2013. The entire contents of the above-mentioned patent application are incorporated by reference as part of the disclosure of this U.S. application.

FIELD

The present disclosure relates to a field of compressors, and more particularly to a refrigerant filling rotary compressor.

BACKGROUND

Generally, the operation process of a refrigerant filling rotary compressor is that when the suction of the compressor is completed, the pressure in the compression chamber of the compressor is lower than that in the refrigerant injecting mouth. Thus, the injection valve is opened in one way to compress the injected gas in the compression chamber. As the piston moves, the volume of the compression chamber gradually decreases, and then the gas pressure therein gradually rises. When the pressure in the compression chamber equals to that in the refrigerant injecting mouth, the injection valve is closed. As the piston further moves, the volume of the compression chamber further decreases, and when the gas pressure therein is slightly higher than the exhaust pressure, the exhaust valve of the compressor is opened to exhaust the gas.

However, the ordinary refrigerant filling rotary compressors have the following defects: due to the presence of the injection valve and the filling mouth, high pressure gas filled in the space of the injection valve and the filling mouth cannot be further compressed and exhausted when the piston moves to the filling mouth. In such a case, an extra clearance volume of the compressor is formed and termed a clearance volume formed by the injection valve, thereby affecting the performance of the compressor. In addition, when the piston moves to the filling mouth, it is possible that the unexhausted gas which is being compressed in the compression chamber may leak into the suction chamber.

SUMMARY

The present disclosure seeks to solve at least one of the problems existing in the related art to at least some extent. Therefore, an objective of the present disclosure is to provide a refrigerant filling rotary compressor that can reduce the loss of performance.

According to a first aspect of the present disclosure, a refrigerant filling rotary compressor includes: a shell; a compressing mechanism disposed in the shell and including a cylinder formed with a cylinder chamber, a sliding vane slot and a gas vent, wherein an inner wall of the cylinder chamber is formed with a filling mouth and the cylinder is provided with a filling channel with a filling hole, a main bearing disposed on the cylinder, an auxiliary bearing disposed below the cylinder, a crank shaft running through the main bearing, the cylinder chamber and the auxiliary bearing, a piston rotatably disposed in the cylinder chamber and fitted over the crank shaft, and a sliding vane movably disposed in the sliding vane slot and defining an end extended into the cylinder chamber to abut against a peripheral surface of the piston; an injection tube passing through the shell and inserted into the filling channel; and an injection valve assembly disposed on the cylinder. The injection valve assembly is in a closed state when a pressure inside the cylinder chamber is higher than that in the filling hole so as to separate the filling hole from the filling mouth, and the injection valve assembly is in an open state when the pressure inside the cylinder chamber is lower than that in the filling hole so as to communicate the filling hole with the filling mouth, wherein when the injection valve assembly is in the closed state, a space between the injection valve assembly and the filling mouth where a compressed gas exists constitutes a clearance volume formed by the injection valve assembly, and a ratio between the clearance volume formed by the injection valve assembly and a reserve volume of the cylinder ranges from 0.3% to 1.5%.

In the refrigerant filling rotary compressor according to embodiments of the present disclosure, since the ratio between the clearance volume formed by the injection valve assembly and the reserve volume of the cylinder ranges from 0.3% to 1.5%, it is possible to guarantee the performance of the refrigerant filling rotary compressor, and to reduce the loss of performance of the refrigerant filling rotary compressor.

According to a particular embodiment of the present disclosure, the injection valve assembly includes: a limiter defining a first end fixed on the cylinder and a second end forming a gap with the cylinder, wherein the gap gradually enlarges in a direction from the first end to the second end of the limiter; and a valve defining a first end disposed between the limiter and the cylinder and a second end bendable around the limiter from a horizontal position to a position away from the cylinder within the gap, when the pressure inside the cylinder chamber is lower than that in the filling hole so as to open the filling hole to communicate the filling hole with the filling mouth. Therefore, the injection valve assembly according to embodiments of the present disclosure has the advantages of simple structure, reasonable design, and good injection effect, so as to achieve high efficiency of the refrigerant filling rotary compressor.

Further, the injection valve assembly further includes a fixing member sequentially passing through the limiter and the valve so as to fix the limiter and the valve on the cylinder, thereby making it easy to assemble the limiter and the valve.

According to some embodiments of the present disclosure, at a center of the filling hole, a minimum distance between the valve and the limiter is a lift H of the valve, and a distance from a bending start point of the valve to the center of the filling hole is a bending length L of the valve. The lift H and the bending length L of the valve satisfy $H/L<0.15$, so as to guarantee the bendability of the valve, so that the valve is not easy to break and the reliability of the injection valve assembly is increased.

In some embodiments of the present disclosure, a line connecting a center of the filling mouth with a center of the cylinder and a center line of the sliding vane slot form an angle A, and a line connecting a center of the gas vent and the center of the cylinder and the center line of the sliding vane slot form an angle B. The angle A and the angle B satisfy $A \leq B+10°$. Therefore, the position of the filling mouth is defined by the position of the gas vent, which can prevent the filling mouth from being too far away from the gas vent, and thus prevent too many refrigerants in a compression chamber from flowing back to a suction chamber when venting is completed.

Specifically, a lower end face of the cylinder and an upper end face of the auxiliary bearing define a mounting space for mounting the injection valve assembly.

According to a second aspect of the present disclosure, the refrigerant filling rotary compressor includes: a shell; a compressing mechanism disposed in the shell and including a first cylinder and a second cylinder each formed with a cylinder chamber, a sliding vane slot and a gas vent, an inner wall of each cylinder chamber being formed with a filling mouth, and each cylinder being provided with a filling channel with a filling hole; a middle baffle plate disposed between the first cylinder and the second cylinder; a main bearing disposed on the first cylinder; an auxiliary bearing disposed below the second cylinder; a crank shaft running through the main bearing, the middle baffle plate and the auxiliary bearing, and fitted with two pistons disposed in the cylinder chambers of the first cylinder and the second cylinder respectively; two sliding vanes movably disposed in corresponding ones of the sliding vane slots and each defining an end extended into a corresponding one of the cylinder chambers to abut against a peripheral surface of a corresponding one of the pistons; two injection tubes passing through the shell and inserted into corresponding ones of the filling channels respectively; two injection valve assemblies disposed on the first cylinder and the second cylinder respectively, each injection valve assembly being in a closed state when a pressure inside a corresponding one of the cylinder chambers is higher than that in a corresponding one of the filling holes so as to separate the filling hole from the filling mouth, and each injection valve assembly being in an open state when a pressure inside a corresponding one of the cylinder chambers is lower than that in a corresponding one of the filling holes so as to communicate the filling hole with the filling mouth, wherein when the two injection valve assemblies are in the closed state, a sum of spaces between the two injection valve assemblies and corresponding ones of the filling mouths where a compressed gas exists constitutes a clearance volume formed by the two injection valve assemblies, and a ratio between the clearance volume formed by the two injection valve assemblies and a sum of reserve volumes of the first cylinder and the second cylinder ranges from 0.3% to 1.5%.

In the refrigerant filling rotary compressor according to embodiments of the present disclosure, since the ratio between the clearance volume formed by the injection valve assemblies and the sum of reserve volumes of the first cylinder and the second cylinder ranges from 0.3% to 1.5%, it is possible to guarantee the performance of the refrigerant filling rotary compressor, and to reduce the loss of performance of the refrigerant filling rotary compressor.

According to a particular embodiment of the present disclosure, each injection valve assembly includes: a limiter defining a first end fixed on a corresponding one of the first cylinder and the second cylinder, and a second end forming a gap with the corresponding one of the first cylinder and the second cylinder, the gap gradually enlarging in a direction from the first end to the second end of the limiter; and a valve defining a first end disposed between the limiter and the corresponding one of the first cylinder and the second cylinder and a second end bendable around the limiter from a horizontal position to a position away from the corresponding one of the first cylinder and the second cylinder within the gap when the pressure inside the corresponding one of the first cylinder and the second cylinder is lower than that in the filling hole so as to open the filling hole to communicate the filling hole with the filling mouth. Therefore, the injection valve assemblies according to embodiments of the present disclosure have the advantages of simple structure, reasonable design, and good injection effect, so as to achieve high efficiency of the refrigerant filling rotary compressor.

Further, each injection valve assembly further includes a fixing member sequentially passing through the limiter and the valve so as to fix the limiter and the valve on the corresponding one of the first cylinder and the second cylinder.

According to some embodiments of the present disclosure, in each injection valve assembly, a minimum distance between the valve and the limiter is a lift H of the valve at a center of the filling hole, and a distance from a bending start point of the valve to the center of the filling hole is a bending length L of the valve. The lift H and the bending length L of the valve satisfy $H/L<0.15$, so as to guarantee the bendability of the valve, so that the valve is not easy to break and the reliability of the injection valve assembly is increased.

In some embodiments of the present disclosure, a line connecting a center of the filling mouth of the first cylinder with a center of the first cylinder and a center line of the sliding vane slot of the first cylinder form an angle E, a line connecting a center of the gas vent of the first cylinder and the center of the first cylinder and the center line of the sliding vane slot of the first cylinder form an angle F. The angle E and the angle F satisfy $E \leq F+10°$. Therefore, the position of the filling mouth of the first cylinder is defined by the position of the gas vent of the first cylinder, which can prevent too many refrigerants in a compression chamber of the first cylinder from flowing back to a suction chamber of the first cylinder when venting is completed.

In some embodiments of the present disclosure, a line connecting a center of the filling mouth of the second cylinder with a center of the second cylinder and a center line of the sliding vane slot of the second cylinder form an angle G, a line connecting a center of the gas vent of the second cylinder and the center of the second cylinder and the center line of the sliding vane slot of the second cylinder form an angle K. The angle E and the angle G satisfy $G \leq K+10°$. Therefore, the position of the filling mouth of the second cylinder is defined by the position of the gas vent of the second cylinder, which can prevent too many refrigerants in a compression chamber of the second cylinder from flowing back to a suction chamber of the second cylinder when venting is completed.

Specifically, a lower end face of the first cylinder and an upper end face of the middle baffle plate define a mounting space for mounting one of the two injection valve assemblies, and an upper end face of the second cylinder and a lower end face of the middle baffle plate define a mounting space for mounting the other one of the two injection valve assemblies. Hence, the structural compactness of the refrigerant filling rotary compressor can be improved.

Additional aspects and advantages of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the present disclosure will become apparent and more readily appreciated from the following descriptions made with reference to the drawings, in which.

REFERENCE NUMBERS

Figure 1:
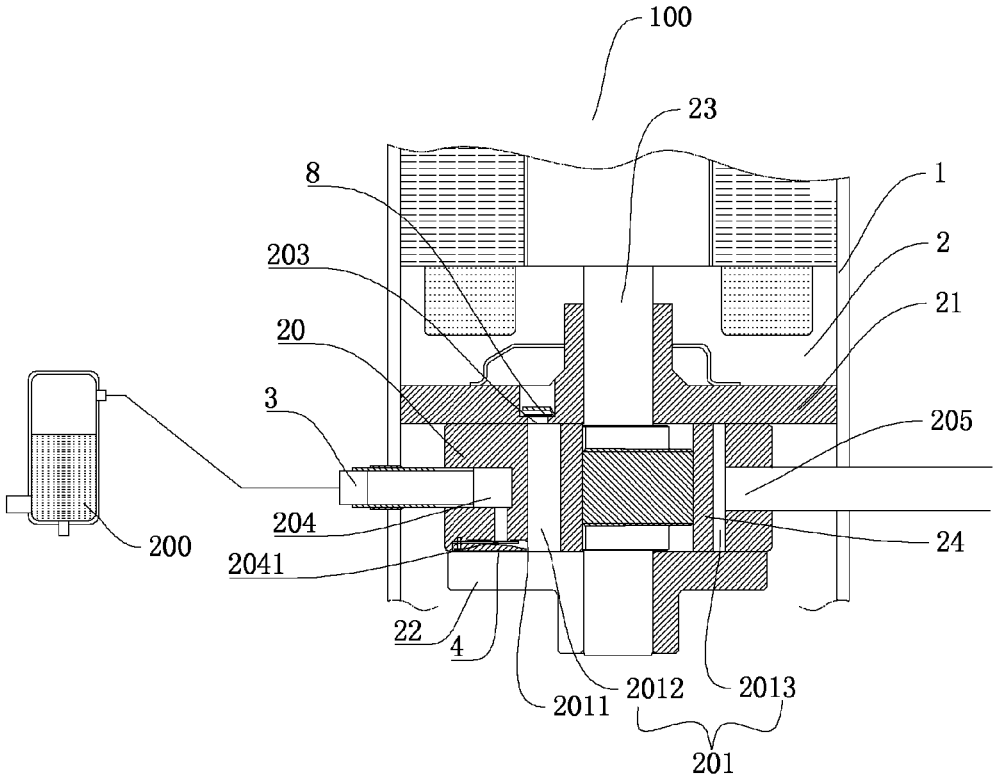
FIG. 1 is a schematic view of a refrigerant filling rotary compressor according to an embodiment of the present disclosure, which includes one cylinder.

100 refrigerant filling rotary compressor
200 gas-liquid separator
1 shell
2 compressing mechanism
20 cylinder
201 cylinder chamber
2011 filling mouth
2012 compression chamber
2013 ventilation chamber
202 sliding vane slot
203 gas vent
204 filling channel
2041 filling hole
205 suction mouth
21 main bearing
22 auxiliary bearing
23 crank shaft
24 piston
25 sliding vane
3 injection tube
4 injection valve assembly
40 limiter
41 valve
42 fixing member
43 gap
5 first cylinder
6 second cylinder
7 middle baffle plate

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, which are used to illustrate the present disclosure, but shall not be construed to limit the present disclosure.

In the description of the present disclosure, it is to be understood that terms such as "central", "upper," "lower," "front," "rear," "left," "right," "vertical," "horizontal," "top," "bottom," "inner," "outer" should be construed to refer to the orientation or position as shown in the drawings under discussion. These relative terms are for convenience of description and do not indicate or imply that the apparatus or members must have a particular orientation or be constructed and operated in a particular orientation. Therefore, these terms shall not be construed to limit the present disclosure.

It shall be noted that terms such as "first" and "second" are used herein for purposes of description and are not intended to indicate or imply relative importance or to imply the number of indicated technical features. Thus, the feature defined with "first" and "second" may explicitly or implicitly include one or more of this feature. Furthermore, in the description of the present disclosure, "a plurality of" means two or more than two, unless specified otherwise.

The refrigerant filling rotary compressor 100 can be applied in refrigeration systems such as air conditioners. The application of the refrigerant filling rotary compressor 100 with a single cylinder in an air conditioner is taken as an example for illustration. The air conditioner includes a gas-liquid separator 200 that separates the liquid refrigerant from the gaseous refrigerant, in which the gaseous refrigerant enters into a cylinder chamber 201 of a cylinder 20 via an injection tube 3. The refrigerant filling rotary compressor 100 includes an injection valve assembly 4, and an inner wall of the cylinder chamber 201 is formed with a filling mouth 2011. When the injection valve assembly 4 is opened, the gaseous refrigerant enters into the cylinder chamber 201 of the cylinder 20 via the filling mouth 2011; when the injection valve assembly 4 is closed, a space between the injection valve assembly 4 and the filling mouth 2011 where a compressed gas exists constitutes a clearance volume formed by the injection valve assembly 4. The structure and operation mechanism of air conditioners are well-known to those skilled in the art, which will not be described in detail herein.

Figure 2:
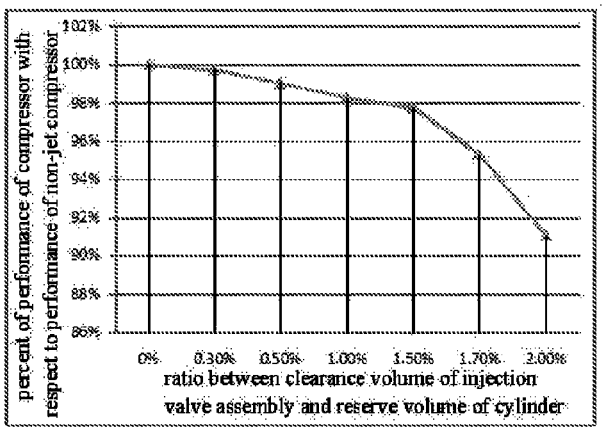
FIG. 2 is a diagram of the relationship between a clearance volume formed by an injection valve assembly of a refrigerant filling rotary compressor and the performance of the compressor according to an embodiment of the present disclosure.

The inventors of the present application have found that the clearance volume formed by the injection valve assembly 4 has influence on the performance of the compressors (COP). As shown in FIG. 2, the inventors have found from lots of experiments that when the ratio between the clearance volume formed by the injection valve assembly 4 and a reserve volume of the cylinder 20 is equal to 0.3%, the performance of the compressor can reach a level of mass production. If the clearance volume formed by the injection valve assembly 4 is further decreased, there is no obvious increase in the performance of the compressor; instead, a smaller clearance volume formed by the injection valve assembly 4 brings about a sharp rise of the manufacturing cost of the injection valve assembly 4 and a sharp drop of the reliability of the injection valve assembly 4. When the ratio between the clearance volume formed by the injection valve assembly 4 and the reserve volume of the cylinder 20 is higher than 1.5%, the performance of the compressor rapidly degrades. The computing method of the reserve volume of the cylinder 20 is well-known to those skilled in the art, which will not be described in detail herein. The present disclosure is based on the above findings.

In the following, a refrigerant filling rotary compressor 100 according to an embodiment of the present disclosure will be described with reference to FIG. 1 to FIG. 5.

With reference to FIG. 1 to FIG. 5, a refrigerant filling rotary compressor 100 according to an embodiment of the present disclosure includes: a shell 1, a compressing mechanism 2, an injection tube 3 and an injection valve assembly 4.

The compressing mechanism 2 is disposed in the shell 1, and includes: a cylinder 20, a main bearing 21, an auxiliary bearing 22, a crank shaft 23, a piston 24, and a sliding vane 25. The cylinder 20 is formed with a cylinder chamber 201, a sliding vane slot 202, a gas vent 203 and a suction mouth 205, an inner wall of the cylinder chamber 201 is formed with a filling mouth 2011, and the cylinder 20 is provided with a filling channel 204 with a filling hole 2041, i.e. an end of the filling channel 204 is the filling hole 2041. The injection tube 3 passes through the shell 1 and is inserted into the filling channel 204, so that the gaseous refrigerant from the outside enters the filling channel 204 via the injection tube 3. The main bearing 21 is disposed on the cylinder 20. The auxiliary bearing 22 is disposed below the cylinder 20. The crank shaft 23 runs through the main bearing 21, the cylinder chamber 201 and the auxiliary bearing 22, and the upper end of the crank shaft 23 is connected with a motor so as to drive the crank shaft 23 to rotate via the motor. The piston 24 is rotatably disposed in the cylinder chamber 201 and fitted over the crank shaft 23. The sliding vane 25 is movably disposed in the sliding vane slot 202 and has an end extended into the cylinder chamber 201 to abut against a peripheral surface of the piston 24.

Figure 4:
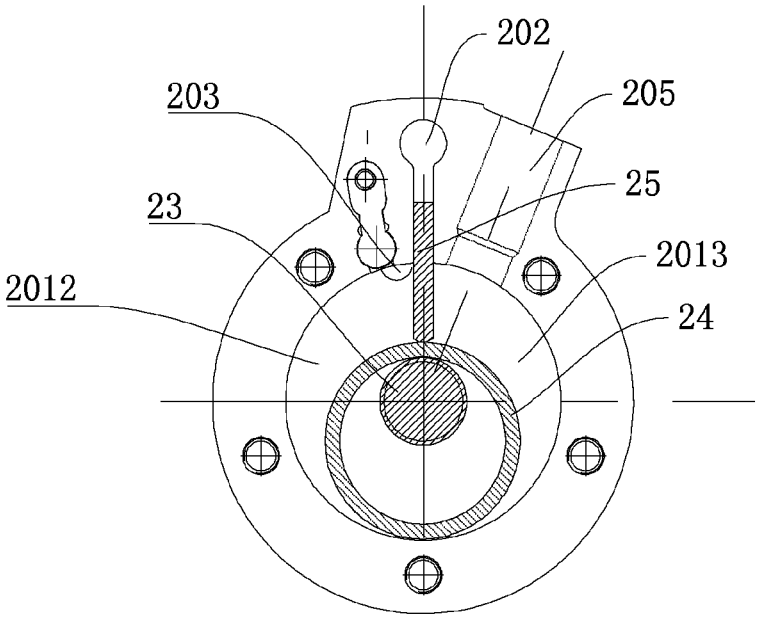
FIG. 4 is a cross-sectional plan view of a cylinder formed with a piston, a crank shaft and a sliding vane according to an embodiment of the present disclosure.

As shown in FIG. 4, the crank shaft 23 drives the piston 24 to rotate; an end of the sliding vane 25 abuts against a peripheral surface of the piston 24; the rotatable piston 24 and sliding vane 25 divide the cylinder chamber 201 into a compression chamber 2012 and a suction chamber 2013, the suction chamber 2013 is communicated with a suction mouth 205, and the compression chamber 2012 is communicated with the gas vent 203 via an exhaust valve 8. As the refrigerant filling rotary compressor 100 operates, the volumes of the compression chamber 2012 and the suction chamber 2013 periodically vary to complete the process of suction and compression. It should be noted that the main bearing 21 and the auxiliary bearing 22 can be provided with a silencer. The operation principle of the compressing mechanism 2 is the same as that of the compressing mechanism 2 of the compressor in the related art, which will not be described in detail herein.

The injection valve assembly 4 is disposed on the cylinder 20. The injection valve assembly 4 is in a closed state when a pressure inside the cylinder chamber 201 is higher than that in the filling hole 2041 so as to separate the filling hole 2041 from the filling mouth 2011, to prevent a compressed gas from flowing back to the filling channel 204. The injection valve assembly 4 is in an open state when the pressure inside the cylinder chamber 201 is lower than that in the filling hole 2041 so as to communicate the filling hole 2041 with the filling mouth 2011, so that the gaseous refrigerant enters the cylinder chamber 201 via the filling hole 2041 and the filling mouth 2011 in sequence. When the injection valve assembly 4 is in the closed state, a space between the injection valve assembly 4 and the filling mouth 2011 where a compressed gas exists constitutes a clearance volume formed by the injection valve assembly 4, and a ratio between the clearance volume formed by the injection valve assembly 4 and a reserve volume of the cylinder 20 ranges from 0.3% to 1.5%.

In the refrigerant filling rotary compressor 100 according to embodiments of the present disclosure, since the ratio between the clearance volume formed by the injection valve assembly 4 and the reserve volume of the cylinder 20 ranges from 0.3% to 1.5%, it is possible to guarantee the performance of the refrigerant filling rotary compressor 100, and to reduce the loss of performance of the refrigerant filling rotary compressor 100.

Specifically, as shown in FIG. 1, a lower end face of the cylinder 20 and an upper end face of the auxiliary bearing 22 define a mounting space for mounting the injection valve assembly 4. In other words, the filling hole 2041 of the filling channel 204 is located in the lower end face of the cylinder 20, and the injection valve assembly 4 is disposed between the lower end face of the cylinder 20 and the upper end face of the auxiliary bearing 22 to open or close the filling hole 2041, but the present disclosure is not limited thereby. The injection valve assembly 4 can also be disposed between an upper end face of the cylinder 20 and a lower end face of the main bearing 21, in which the filling hole 2041 of the filling channel 204 is located in the upper end face of the cylinder 20.

Figure 3:
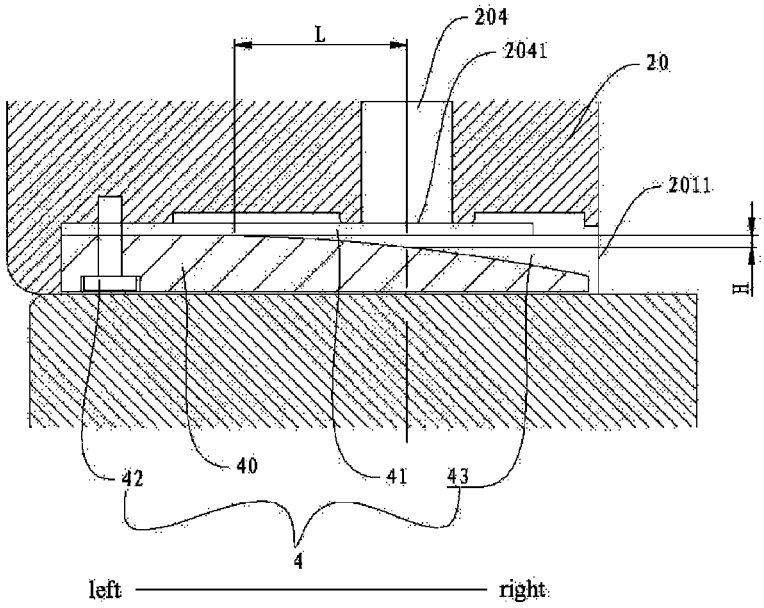
FIG. 3 is a schematic view of an injection valve assembly disposed on the cylinder according to an embodiment of the present disclosure.

As shown in FIGS. 1 and 3, in a specific embodiment of the present disclosure, the injection valve assembly 4 includes a limiter 40 and a valve 41, in which the limiter 40 has a first end fixed on the cylinder 20 and a second end forming a gap 43 with the cylinder 20, and the gap 43 gradually enlarges in a direction from the first end to the second end of the limiter 40. The valve 41 has a first end disposed between the limiter 40 and the cylinder 20 and a second end bendable around the limiter 40 from a horizontal position to a position away from the cylinder 20 within the gap 43 when the pressure inside the cylinder chamber 201 is lower than that in the filling hole 2041 so as to open the filling hole 2041 to communicate the filling hole 2041 with the filling mouth 2011. When the pressure inside the cylinder chamber 201 is higher than that in the filling hole 2041, the valve 41 is in a normal state in a horizontal position, i.e. in an undeformed state to close the filling hole 2041. Therefore, the injection valve assembly 4 according to embodiments of the present disclosure has the advantages of simple structure, reasonable design, and good injection effect, so as to achieve high efficiency of the refrigerant filling rotary compressor 100.

In an example of the present disclosure, as shown in FIG. 3, when the injection valve assembly 4 is disposed on the lower end face of the cylinder 20, the valve 41 is a deformable platelike body; a left end of the valve 41 is fixed on the lower end face of the cylinder 20 to dispose the valve 41 below the filling hole 2041; a left end of the limiter 40 is fixed on the lower surface of the left end of the valve 41; a right end of the limiter 40 and the lower end face of the cylinder 20 define a gap 43 which enlarges in a direction from left to right. In such a case, when the pressure inside the cylinder chamber 201 is lower than that in the filling hole 2041, the valve 41 bends downward from a horizontal position around the limiter 40 within the gap 43 to open the filling hole 2041, while the valve 41 returns to the horizontal position to close the filling hole 2041 when the pressure inside the cylinder chamber 201 is higher than that in the filling hole 2041.

When the injection valve assembly 4 is disposed on the upper end face of the cylinder 20, the valve 41 is disposed on the upper end face of the cylinder 20 and above the filling hole 2041, and the limiter 40 is disposed over the valve 41. In such a case, when the pressure inside the cylinder chamber 201 is lower than that in the filling hole 2041, the valve 41 bends upward from a horizontal position around the limiter 40 within the gap 43 to open the filling hole 2041.

Further, the injection valve assembly 4 also includes a fixing member 42 which sequentially passes through the limiter 40 and the valve 41 so as to fix the limiter 40 and the valve 41 on the cylinder 20. In other words, the limiter 40 and the valve 41 are fixed on the cylinder 20 by means of the fixing member 42, thereby facilitating the assembly of the limiter 40 and the valve 41. Specifically, the fixing member 42 can be a bolt or a rivet.

In some embodiments of the present disclosure, as shown in FIG. 3, at a center of the filling hole 5041, a minimum distance between the valve 41 and the limiter 40 is a lift H of the valve 41, and a distance from a bending start point of the valve 41 to the center of the filling hole 2041 is a bending length L of the valve 41. The lift H of the valve 41 and the bending length L of the valve 41 satisfy $H/L<0.15$, so as to guarantee the bendability of the valve 41, so that the valve 41 is not easy to break and the reliability of the injection valve assembly 4 is increased.

According to some embodiments of the present disclosure, a line connecting a center of the filling mouth 2011 with a center of the cylinder 20 and a center line of the sliding vane slot 202 form an angle A, and a line connecting a center of the gas vent 203 and the center of the cylinder 20 and the center line of the sliding vane slot 202 form an angle B. The angle A and the angle B satisfy $A \leq B+10°$. Therefore, the position of the filling mouth 2011 is defined by the position of the gas vent 203, which can prevent the filling mouth 2011 from being too far away from the gas vent 203, and thus prevent too many refrigerants in the compression chamber 2012 from flowing back to the suction chamber 2013 when venting is completed.

Figure 5:
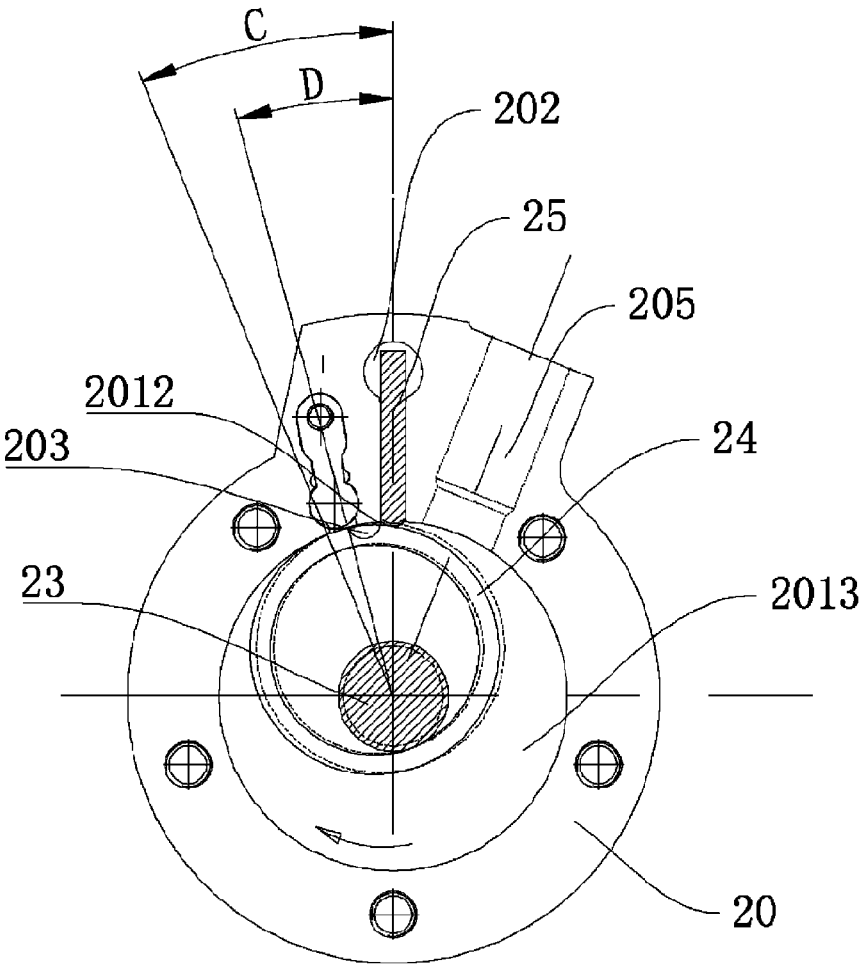
FIG. 5 is a schematic view of a piston moving to an edge of a gas vent and a piston moving to an edge of a filling mouth according to an embodiment of the present disclosure.

In other embodiments of the present disclosure, as shown in FIG. 5, the position of the filling mouth 2011 can be defined in accordance with the position of the gas vent 203 by the following means. In the process of the movement of the piston 24, when the piston 24 moves to a position where the peripheral wall of the piston 24 is in contact with the edge position of the filling mouth 2011 in such a way that the filling mouth 2011 does not but is ready to communicate with the suction chamber 2013 (shown by the solid lines in FIG. 5), i.e. the peripheral wall of the piston 24 is in contact with the edge position of the filling mouth 2011, the filling mouth 2011 can communicate with the suction chamber 2013 only if the piston 24 continues moving. In such a case, a line connecting a center of the piston 24 and the center of the cylinder 20 is at an angle C with the motion direction of the sliding vane 25.

The piston 24 continues moving. When the piston 24 moves to a position where the peripheral wall of the piston 24 is in contact with the edge position of the gas vent 203 in such a way that the gas vent 203 does not but is ready to communicate with the suction chamber 2013, i.e. the peripheral wall of the piston 24 is in contact with the edge position of the gas vent 203 (shown by the dotted lines in FIG. 5), the gas vent 203 can communicate with the suction chamber 2013 only if the piston 24 continues moving. In such a case, a line connecting the center of the piston 24 and the center of the cylinder 20 is at an angle D with the motion direction of the sliding vane 25. The angle C and the angle D satisfy $C \leq D+10°$.

In the following, a refrigerant filling rotary compressor 100 according to another embodiment of the present disclosure will be described with reference to FIG. 3 to FIG. 6.

Figure 6:
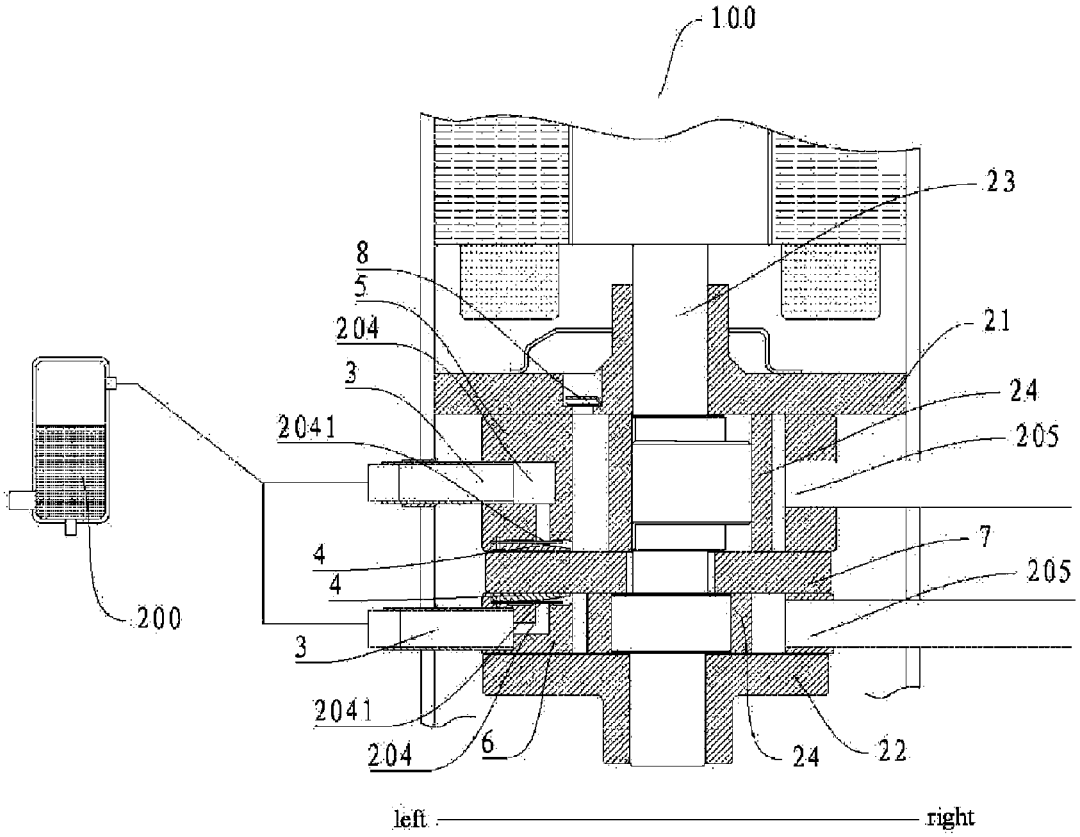
FIG. 6 is a schematic view of a refrigerant filling rotary compressor according to another embodiment of the present disclosure, which includes a first cylinder and a second cylinder.

With reference to FIG. 6, a refrigerant filling rotary compressor 100 according to an embodiment of the present disclosure includes: a shell 1, a compressing mechanism 2, two injection tubes 3 and two injection valve assemblies 4. The compressing mechanism 2 is disposed in the shell 1. An end of each injection tube 3 is disposed outside the shell 1 and connected with a gas-liquid separator 200, while the other end of the each injection tube 3 is disposed in the shell 1.

The compressing mechanism 2 includes: a first cylinder 5 and a second cylinder 6, a middle baffle plate 7, a main bearing 21, an auxiliary bearing 22, a crank shaft 2 and two sliding vanes 25. The first cylinder 5 is disposed above the second cylinder 6; and the first cylinder 5 and the second cylinder 6 are each formed with a cylinder chamber 201, a sliding vane slot 202, a gas vent 203 and a suction mouth 205. In other words, the first cylinder 5 is formed with a cylinder chamber 201, a sliding vane slot 202, a gas vent 203 and a suction mouth 205, and the second cylinder 6 is formed with a cylinder chamber 201, a sliding vane slot 202, a gas vent 203 and a suction mouth 205. The inner wall of each cylinder chamber 201 is formed with a filling mouth 2011. The first cylinder 5 and the second cylinder 6 are each provided with a filling channel 204 with a filling hole 2041. Each injection tube 3 passes through the shell 1 and is inserted into a corresponding one of the filling channels 204.

The middle baffle plate 7 is disposed between the first cylinder 5 and the second cylinder 6. The main bearing 21 is disposed on the first cylinder 5, and the auxiliary bearing 22 is disposed below the second cylinder 6. The crank shaft 23 runs through the main bearing 21, the middle baffle plate 7 and the auxiliary bearing 22, and is fitted with two pistons 24 disposed in the cylinder chambers 201 of the first cylinder 5 and the second cylinder 6 respectively. In other words, a piston 24 is rotatably disposed in the cylinder chamber 201 of the first cylinder 5, and a piston 24 is rotatably disposed in the cylinder chamber 201 of the second cylinder 6. Each sliding vane 25 is movably disposed in a corresponding one of the sliding vane slots 202 and has an end extended into a corresponding one of the cylinder chambers 201 to abut against a peripheral surface of a corresponding one of the pistons 24.

The crank shaft 23 drives the two pistons 24 to move in corresponding ones of the cylinder chambers 201, and an end of each sliding vane 25 abuts against a peripheral surface of a corresponding one of the pistons 24. The piston 24 and the sliding vane 25 moving on the first cylinder 5 divide the cylinder chamber 201 of the first cylinder 5 into a compression chamber 2012 and a suction chamber 2013, and the piston 24 and the sliding vane 25 moving on the second cylinder 6 divide the cylinder chamber 201 of the second cylinder 6 into a compression chamber 2012 and a suction chamber 2013. It should be noted that the operation principle of the compressing mechanism 2 is the same as that of the compressing mechanism 2 of the compressor with double cylinders in the related art, which will not be described in detail herein.

The two injection valve assemblies 4 are disposed on the first cylinder 5 and the second cylinder 6 respectively. Each injection valve assembly 4 is in a closed state when a pressure inside a corresponding one of the cylinder chambers 201 is higher than that in a corresponding one of the filling holes 2041 so as to separate the filling hole 2041 from the filling mouth 2011, and each injection valve assembly 4 is in an open state when the pressure inside a corresponding one of the cylinder chambers 201 is lower than that in a corresponding one of the filling holes 2041 so as to communicate the filling hole 2041 with the filling mouth 2011. When the two injection valve assemblies 4 are in the closed state, a sum of spaces between the two injection valve assemblies 4 and corresponding ones of the filling mouths 2011 where a compressed gas exists constitute a clearance volume formed by the two injection valve assemblies 4, and a ratio between the clearance volume formed by the two injection valve assemblies 4 and a sum of reserve volumes of the first cylinder 5 and the second cylinder 6 ranges from 0.3% to 1.5%.

In the refrigerant filling rotary compressor 100 according to embodiments of the present disclosure, since the ratio between the clearance volume formed by the injection valve assemblies 4 and the sum of the reserve volumes of the first cylinder 5 and the second cylinder 6 ranges from 0.3% to 1.5%, it is possible to guarantee the performance of the refrigerant filling rotary compressor 100, and to reduce the loss of performance of the refrigerant filling rotary compressor 100.

Specifically, a lower end face of the first cylinder 5 and an upper end face of the middle baffle plate 7 define a mounting space for mounting one of the two injection valve assemblies 4, and an upper end face of the second cylinder 6 and a lower end face of the middle baffle plate 7 define a mounting space for mounting the other one of the two injection valve assemblies 4. In other words, the injection valve assembly 4 on the first cylinder 5 is disposed between the lower end face of the first cylinder 5 and the upper end face of the middle baffle plate 7, and the injection valve assembly 4 on the second cylinder 6 is disposed between the upper end face of the second cylinder 6 and the lower end face of the middle baffle plate 7. Hence, the structural compactness of the refrigerant filling rotary compressor 100 can be improved.

In some embodiments of the present disclosure, as shown in FIG. 3 and FIG. 6, each injection valve assembly 4 includes a limiter 40 and a valve 41. The limiter 40 has a first end fixed on a corresponding one of the first cylinder 5 and the second cylinder 6, and a second end forming a gap with the corresponding one of the first cylinder 5 and the second cylinder 6, and the gap gradually enlarges in a direction from the first end to the second end of the limiter 40. The valve 41 has a first end disposed between the limiter 40 and the corresponding one of the first cylinder 5 and the second cylinder 6, and a second end bendable around the limiter 40 from a horizontal position to a position away from the corresponding one of the first cylinder 5 and the second cylinder 6 within the gap 43 when the pressure inside the cylinder chamber 201 is lower than that in the filling hole 2041 so as to open the filling hole 2041 to communicate the filling hole 2041 with the filling mouth 2011. When the pressure inside the cylinder chamber 201 is higher than that in the filling hole 2041, the valve 41 is in the horizontal position to close the filling hole 2041. Therefore, the injection valve assemblies 4 according to embodiments of the present disclosure have the advantages of simple structure, reasonable design, and good injection effect, so as to achieve high efficiency of the refrigerant filling rotary compressor 100.

As shown in FIG. 6, the positional relationship of the components of the injection valve assembly 4 of the first cylinder 5 is presented as follows: a left end of the valve 41 is fixed on the lower end face of the first cylinder 5; a left end of the limiter 40 is fixed on the lower end face of the valve 41; a right end of the limiter 40 and the lower end face of the first cylinder 5 define a gap 43 which enlarges in a direction from left to right. In such a case, when the pressure inside the cylinder chamber 201 of the first cylinder 5 is lower than that in the filling hole 2041 of the first cylinder 5, the valve 41 bends downward from a horizontal position around the limiter 40 within the gap 43 to open the filling hole 2041, while the valve 41 returns to the horizontal position to close the filling hole 2041 when the pressure inside the cylinder chamber 201 of the first cylinder 5 is higher than that in the filling hole 2041 of the first cylinder 5.

The positional relationship of the components of the injection valve assembly 4 of the second cylinder 6 is presented as follows: a left end of the valve 41 is fixed on the upper end face of the second cylinder 6; a left end of the limiter 40 is fixed on the upper end face of the valve 41; a right end of the limiter 40 and the upper end face of the second cylinder 6 define a gap 43 which enlarges in a direction from left to right. In such a case, when the pressure inside the cylinder chamber 201 of the second cylinder 6 is lower than that in the filling hole 2041 of the second cylinder 6, the valve 41 bends upward from a horizontal position around the limiter 40 within the gap 43 to open the filling hole 2041, while the valve 41 returns to the horizontal position to close the filling hole 2041 when the pressure inside the cylinder chamber 201 of the second cylinder 6 is higher than that in the filling hole 2041 of the second cylinder 6.

Further, each injection valve assembly 4 further includes a fixing member 42 sequentially passing through the limiter 40 and the valve 41 so as to fix the limiter 40 and the valve 41 on the corresponding one of the first cylinder 5 and the second cylinder 6, which makes it easy to assemble the limiter 40 and the valve 41. Specifically, the fixing member 42 can be a bolt or a rivet.

In some embodiments of the present disclosure, as shown in FIG. 3, in each injection valve assembly 4, a minimum distance between the valve 41 and the limiter 40 is a lift H of the valve 41 at a center of the filling hole 2041, and a distance from a bending start point of the valve 41 to the center of the filling hole 2041 is a bending length L of the valve 41. The lift H and the bending length L of the valve 41 satisfy $H/L<0.15$. Specifically, the lift H of the valve 41 in the injection valve assembly 4 on the first cylinder 5 refers to the distance between the lower surface of the valve 41 and the upper surface of the limiter 40 at the center of the filling hole 2041 of the first cylinder 5, and the lift H of the valve 41 in the injection valve assembly 4 on the second cylinder 6 refers to the distance between the upper surface of the valve 41 and the limiter 40 at the center of the filling hole 2041 on the second cylinder 6. Therefore, since the ratio between the lift H of the valve 41 and the bending length L of the valve 41 is less than 0.15, the bendability of the valve 41 can be guaranteed, and the valve 41 is not easy to break, which improves the reliability of the injection valve assemblies 4.

In some embodiments of the present disclosure, a line connecting a center of the filling mouth 2011 of the first cylinder 5 with a center of the first cylinder 5 and a center line of the sliding vane slot 202 of the first cylinder 5 form an angle E, and a line connecting a center of the gas vent 203 of the first cylinder 5 and the center of the first cylinder 5 and the center line of the sliding vane slot 202 of the first cylinder 5 form an angle F. The angle E and the angle F satisfy $E \leq F+10°$. Therefore, the position of the filling mouth 2011 of the first cylinder 5 is defined by the position of the gas vent 203 of the first cylinder 5, which can prevent too many refrigerants in a compression chamber 2012 of the first cylinder 5 from flowing back to a suction chamber 2013 of the first cylinder 5 when venting is completed.

Further, a line connecting a center of the filling mouth 2011 of the second cylinder 6 with a center of the second cylinder 6 and a center line of the sliding vane slot 202 of the second cylinder 6 form an angle G, and a line connecting a center of the gas vent 203 of the second cylinder 6 and the center of the second cylinder 6 and the center line of the sliding vane slot 202 of the second cylinder 6 form an angle K. The angle G and the angle K satisfy G≤K+10°. Therefore, the position of the filling mouth 2011 of the second cylinder 6 is defined by the position of the gas vent 203 of the second cylinder 6, which can prevent too many refrigerants in the compression chamber 2012 of the second cylinder 6 from flowing back to the suction chamber 2013 of the second cylinder 6 when venting is completed.

Other components and operation of the refrigerant filling rotary compressor 100 according to embodiments of the present disclosure are known to those skilled in the art, which will not be described in detail herein.

Reference throughout this specification to "an embodiment," "some embodiments," "exemplary embodiments," "examples," "specific examples," or "some examples," means that a particular feature, structure, material, or characteristic described in connection with the embodiment or example is included in at least one embodiment or example of the present disclosure. Thus, these terms throughout this specification do not necessarily refer to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure. The scope of the present disclosure is defined by the claims and the like.

What is claimed is:

1. A refrigerant filling rotary compressor comprising:

a shell;

a compressing mechanism disposed in the shell and comprising:

a cylinder formed with a cylinder chamber, a sliding vane slot and a gas vent, an inner wall of the cylinder chamber being formed with a filling mouth, and the cylinder being provided with a filling channel with a filling hole;

a main bearing disposed on the cylinder;

an auxiliary bearing disposed below the cylinder;

a crank shaft running through the main bearing, the cylinder chamber and the auxiliary bearing;

a piston rotatably disposed in the cylinder chamber and fitted over the crank shaft;

a sliding vane movably disposed in the sliding vane slot and defining an end extended into the cylinder chamber to abut against a peripheral surface of the piston;

an injection tube passing through the shell and inserted into the filling channel;

an injection valve assembly disposed on the cylinder, the injection valve assembly being in a closed state when a pressure inside the cylinder chamber is higher than that in the filling hole so as to separate the filling hole from the filling mouth, and the injection valve assembly being in an open state when the pressure inside the cylinder chamber is lower than that in the filling hole so as to communicate the filling hole with the filling mouth, wherein when the injection valve assembly is in the closed state, a space between the injection valve assembly and the filling mouth where a compressed gas exists constitutes a clearance volume formed by the injection valve assembly, and a ratio between the clearance volume formed by the injection valve assembly and a reserve volume of the cylinder ranges from 0.3% to 1.5%.

2. The refrigerant filling rotary compressor according to claim 1, wherein the injection valve assembly comprises:

a limiter defining a first end fixed on the cylinder and a second end forming a gap with the cylinder, the gap gradually enlarging in a direction from the first end to the second end of the limiter; and a valve defining a first end disposed between the limiter and the cylinder and a second end bendable around the limiter from a horizontal position to a position away from the cylinder within the gap when the pressure inside the cylinder chamber is lower than that in the filling hole so as to open the filling hole to communicate the filling hole with the filling mouth.

3. The refrigerant filling rotary compressor according to claim 2, wherein a lower end face of the cylinder and an upper end face of the auxiliary bearing define a mounting space for mounting the injection valve assembly.

4. The refrigerant filling rotary compressor according to claim 2, wherein the injection valve assembly further comprises a fixing member sequentially passing through the limiter and the valve so as to fix the limiter and the valve on the cylinder.

5. The refrigerant filling rotary compressor according to claim 4, wherein a lower end face of the cylinder and an upper end face of the auxiliary bearing define a mounting space for mounting the injection valve assembly.

6. The refrigerant filling rotary compressor according to claim 2, wherein at a center of the filling hole, a minimum distance between the valve and the limiter is a lift H of the valve, a distance from a bending start point of the valve to the center of the filling hole is a bending length L of the valve, and the lift H and the bending length L of the valve satisfy H/L<0.15.

7. The refrigerant filling rotary compressor according to claim 6, wherein a lower end face of the cylinder and an upper end face of the auxiliary bearing define a mounting space for mounting the injection valve assembly.

8. The refrigerant filling rotary compressor according to claim 1, wherein a line connecting a center of the filling mouth with a center of the cylinder and a center line of the sliding vane slot form an angle A, a line connecting a center of the gas vent and the center of the cylinder and the center line of the sliding vane slot form an angle B, and the angle A and the angle B satisfy A≤B+10°.

9. The refrigerant filling rotary compressor according to claim 1, wherein a lower end face of the cylinder and an upper end face of the auxiliary bearing define a mounting space for mounting the injection valve assembly.

10. A refrigerant filling rotary compressor comprising:

a shell;

a compressing mechanism disposed in the shell and comprising:

a first cylinder and a second cylinder each formed with a cylinder chamber, a sliding vane slot and a gas vent, an inner wall of each cylinder chamber being formed with a filling mouth, and each cylinder being provided with a filling channel with a filling hole;

a middle baffle plate disposed between the first cylinder and the second cylinder;

a main bearing disposed on the first cylinder;

an auxiliary bearing disposed below the second cylinder;

a crank shaft running through the main bearing, the middle baffle plate and the auxiliary bearing, and fitted with two pistons disposed in the cylinder chambers of the first cylinder and the second cylinder respectively;

two sliding vanes movably disposed in corresponding ones of the sliding vane slots and each defining an end extended into a corresponding one of the cylinder chambers to abut against a peripheral surface of a corresponding one of the pistons;

two injection tubes passing through the shell and inserted into corresponding ones of the filling channels respectively;

two injection valve assemblies disposed on the first cylinder and the second cylinder respectively, each injection valve assembly being in a closed state when a pressure inside a corresponding one of the cylinder chambers is higher than that in a corresponding one of the filling holes so as to separate the filling hole from the filling mouth, and each injection valve assembly being in an open state when a pressure inside a corresponding one of the cylinder chambers is lower than that in a corresponding one of the filling holes so as to communicate the filling hole with the filling mouth, wherein when the two injection valve assemblies are in the closed state, a sum of spaces between the two injection valve assemblies and corresponding ones of the filling mouths where a compressed gas exists constitutes a clearance volume formed by the two injection valve assemblies, and a ratio between the clearance volume formed by the two injection valve assemblies and a sum of reserve volumes of the first cylinder and the second cylinder ranges from 0.3% to 1.5%.

11. The refrigerant filling rotary compressor according to claim 10, wherein each injection valve assembly comprises:

a limiter defining a first end fixed on a corresponding one of the first cylinder and the second cylinder, and a second end forming a gap with the corresponding one of the first cylinder and the second cylinder, the gap gradually enlarging in a direction from the first end to the second end of the limiter; and a valve defining a first end disposed between the limiter and the corresponding one of the first cylinder and the second cylinder and a second end bendable around the limiter from a horizontal position to a position away from the corresponding one of the first cylinder and the second cylinder within the gap when the pressure inside the corresponding one of the first cylinder and the second cylinder is lower than that in the filling hole so as to open the filling hole to communicate the filling hole with the filling mouth.

12. The refrigerant filling rotary compressor according to claim 11, wherein a lower end face of the first cylinder and an upper end face of the middle baffle plate define a mounting space for mounting one of the two injection valve assemblies, and an upper end face of the second cylinder and a lower end face of the middle baffle plate define a mounting space for mounting the other one of the two injection valve assemblies.

13. The refrigerant filling rotary compressor according to claim 11, wherein each injection valve assembly further comprises a fixing member sequentially passing through the limiter and the valve so as to fix the limiter and the valve on the corresponding one of the first cylinder and the second cylinder.

14. The refrigerant filling rotary compressor according to claim 13, wherein a lower end face of the first cylinder and an upper end face of the middle baffle plate define a mounting space for mounting one of the two injection valve assemblies, and an upper end face of the second cylinder and a lower end face of the middle baffle plate define a mounting space for mounting the other one of the two injection valve assemblies.

15. The refrigerant filling rotary compressor according to claim 11, wherein in each injection valve assembly, a minimum distance between the valve and the limiter is a lift H of the valve at a center of the filling hole, a distance from a bending start point of the valve to the center of the filling hole is a bending length L of the valve, and the lift H and the bending length L of the valve satisfy $H/L<0.15$.

16. The refrigerant filling rotary compressor according to claim 15, wherein a lower end face of the first cylinder and an upper end face of the middle baffle plate define a mounting space for mounting one of the two injection valve assemblies, and an upper end face of the second cylinder and a lower end face of the middle baffle plate define a mounting space for mounting the other one of the two injection valve assemblies.

17. The refrigerant filling rotary compressor according to claim 10, wherein a line connecting a center of the filling mouth of the first cylinder with a center of the first cylinder and a center line of the sliding vane slot of the first cylinder form an angle E, a line connecting a center of the gas vent of the first cylinder and the center of the first cylinder and the center line of the sliding vane slot of the first cylinder form an angle F, and the angle E and the angle F satisfy $E \leq F+10°$.

18. The refrigerant filling rotary compressor according to claim 17, wherein a lower end face of the first cylinder and an upper end face of the middle baffle plate define a mounting space for mounting one of the two injection valve assemblies, and an upper end face of the second cylinder and a lower end face of the middle baffle plate define a mounting space for mounting the other one of the two injection valve assemblies.

19. The refrigerant filling rotary compressor according to claim 10, wherein a line connecting a center of the filling mouth of the second cylinder with a center of the second cylinder and a center line of the sliding vane slot of the second cylinder form an angle G, a line connecting a center of the gas vent of the second cylinder and the center of the second cylinder and the center line of the sliding vane slot of the second cylinder form an angle K, and the angle G and the angle K satisfy $G \leq K+10°$.

20. The refrigerant filling rotary compressor according to claim 10, wherein a lower end face of the first cylinder and an upper end face of the middle baffle plate define a mounting space for mounting one of the two injection valve assemblies, and an upper end face of the second cylinder and a lower end face of the middle baffle plate define a mounting space for mounting the other one of the two injection valve assemblies.

* * * * *